US009880504B2

(12) United States Patent
Suzuki

(10) Patent No.: US 9,880,504 B2
(45) Date of Patent: Jan. 30, 2018

(54) IMAGE FORMING APPARATUS INCLUDING A DISPERSING MECHANISM

(71) Applicant: FUJI XEROX CO., LTD., Tokyo (JP)

(72) Inventor: Shiro Suzuki, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/213,925

(22) Filed: Jul. 19, 2016

(65) Prior Publication Data

US 2017/0255151 A1 Sep. 7, 2017

(30) Foreign Application Priority Data

Mar. 2, 2016 (JP) ..... 2016-040251

(51) Int. Cl.
*G03G 15/00* (2006.01)
*G03G 15/10* (2006.01)

(52) U.S. Cl.
CPC ..... *G03G 15/556* (2013.01); *G03G 15/104* (2013.01)

(58) Field of Classification Search
CPC ..... G03G 15/556; G03G 15/104
USPC ..... 399/237
See application file for complete search history.

(56) References Cited

U.S. PATENT DOCUMENTS 5,345,296 A * 9/1994 Wellings ..... G03G 15/104 106/31.6
5,530,533 A * 6/1996 Wallace ..... G03G 15/104 399/237
5,930,555 A * 7/1999 Lee ..... G03G 15/104 399/238

FOREIGN PATENT DOCUMENTS

JP 2000-338785 A 12/2000

* cited by examiner

*Primary Examiner* — Billy Lactaoen
(74) *Attorney, Agent, or Firm* — Oliff PLC

(57) ABSTRACT

Provided is an image forming apparatus including a storage portion that stores liquid developer where toner is dispersed in a carrier liquid, an image forming portion that forms an image on a recording medium with the liquid developer supplied from the storage portion, a recovery path that recovers the liquid developer from the image forming portion and returns the liquid developer to the storage portion, a dispersing mechanism that is provided in the recovery path and disperses recovered liquid developer by causing the recovered liquid developer to pass through a net member, and a replenishing unit that replenishes the liquid developer or the carrier liquid on the net member at least while the image forming portion does not form an image.

21 Claims, 12 Drawing Sheets

IMAGE FORMING APPARATUS INCLUDING A DISPERSING MECHANISM

CROSS-REFERENCE TO RELATED APPLICATIONS

This application is based on and claims priority under 35 USC 119 from Japanese Patent Application No. 2016-040251 filed Mar. 2, 2016.

BACKGROUND

Technical Field

The invention relate to an image forming apparatus.

SUMMARY

According to an aspect of the invention, there is provided an image forming apparatus including:

a storage portion that stores liquid developer where toner is dispersed in a carrier liquid;

an image forming portion that forms an image on a recording medium with the liquid developer supplied from the storage portion;

a recovery path that recovers the liquid developer from the image forming portion and returns the liquid developer to the storage portion;

a dispersing mechanism that is provided in the recovery path and disperses recovered liquid developer by causing the recovered liquid developer to pass through a net member; and a replenishing unit that replenishes the liquid developer or the carrier liquid on the net member at least while the image forming portion does not form an image.

BRIEF DESCRIPTION OF THE DRAWINGS

Exemplary embodiments of the present invention will be described in detail based on the following figures, wherein.

DETAILED DESCRIPTION

First Exemplary Embodiment

An image forming apparatus according to a first exemplary embodiment of the invention will be described.

Figure 1:
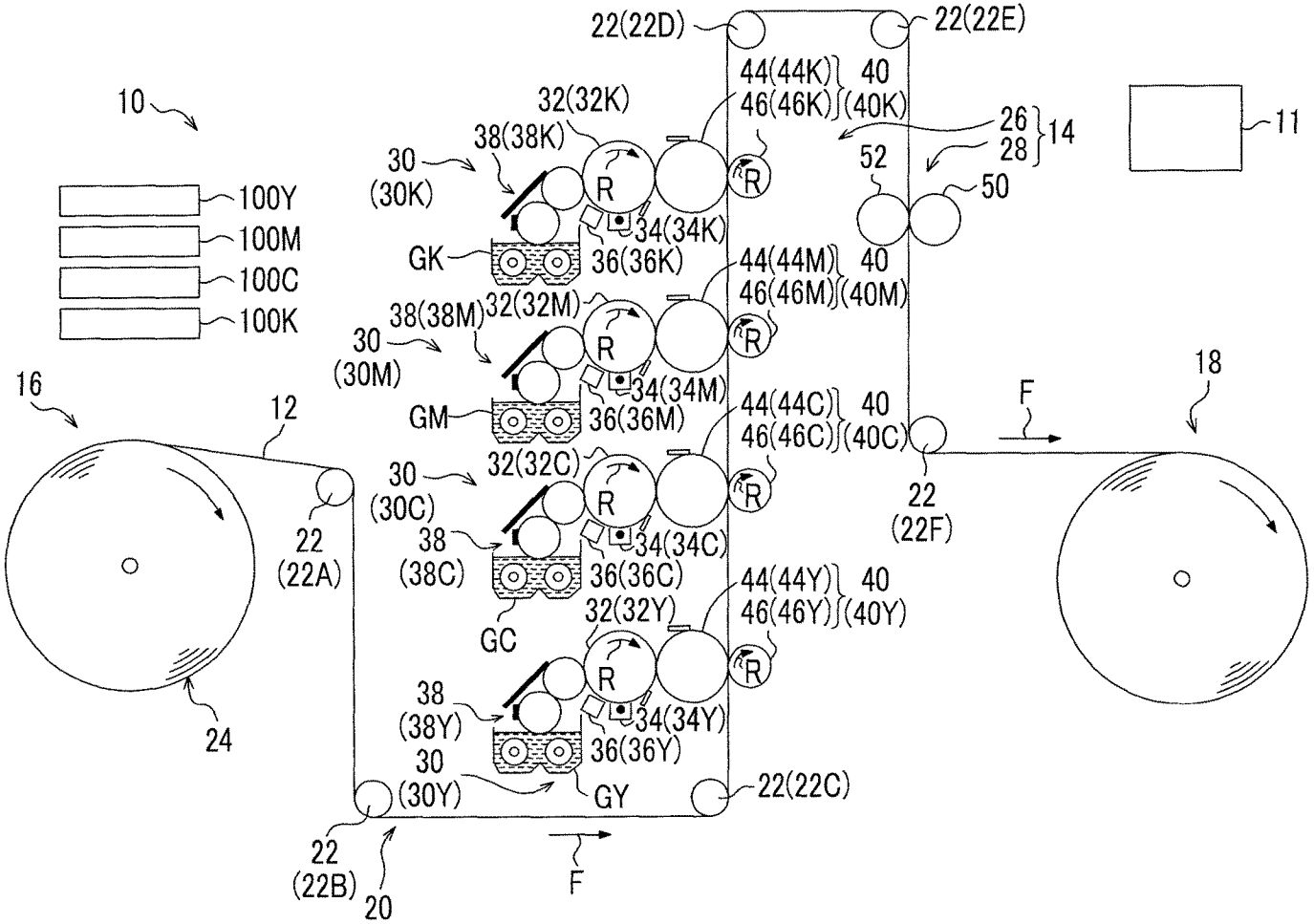
FIG. 1 is a configuration view illustrating an image forming apparatus of a first exemplary embodiment of the invention.

FIG. 1 illustrates a configuration of a main portion of an image forming apparatus 10 according to the exemplary embodiment. The image forming apparatus 10 adopts an electrophotographic system and forms an image corresponding to image data on a recording medium such as a film 12 using liquid developer G where toner is dispersed in a carrier liquid of which a main component is volatile solvent. In addition, the liquid developer G has a charging polarity of charging in a predetermined polarity (positive (plus) polarity or negative (minus) polarity). Moreover, in the exemplary embodiment, the liquid developer G has the charging polarity of charging in the positive (plus) polarity.

Entire Configuration

The image forming apparatus 10 forms an image corresponding to the image data on the elongated film 12 as an example of the recording medium by using the liquid developer G (in a case in which colors are distinguished, it refers to GY, GM, GC, and GK) of each color of Y, M, C, and K described below. Moreover, the image forming apparatus 10 is not limited to the elongated film 12 and may be configured to form an image on, for example, a sheet-shaped film, a recording sheet, and the like in addition to the film. In addition, the image forming apparatus 10 may adopt a known configuration to which the electrophotographic system is applied, detailed description will be omitted.

The image forming apparatus 10 includes a controller 11, a developer device 100, an image forming portion 14, a film supply portion 16, a film discharge portion 18, and the like.

The controller 11 controls an entire apparatus in which a computer to which a Central Processing Unit (CPU), a Random Access Memory (RAM), nonvolatile memories such as a Read Only Memory (ROM) and a Hard Disk Drive (HDD), and the like are connected by a bus, various input and output interfaces, various driver circuits, and the like are provided.

A transporting path 20 of the film 12 is formed in the image forming apparatus 10. Plural transporting rolls 22 (as an example, transporting rolls 22A, 22B, 22C, 22D, 22E, and 22F are illustrated in FIG. 1 are disposed in the transporting path 20. Hereinafter, in a case in which the transporting rolls are not distinguished, it is referred to as the transporting roll 22) are disposed in the transporting path 20. At least one of the transporting rolls 22 is driven to be rotated and thereby the film 12 is transported along the transporting path 20 at a predetermined transporting speed.

A film roll 24 around which the elongated film 12 is wound in a roll shape is mounted on the film supply portion 16. The film 12 is pulled out from an outer peripheral end of the film roll 24 mounted on the film supply portion 16, is fed into the transporting path 20, and is transported from the film supply portion 16 to the film discharge portion 18 via the image forming portion 14 along the transporting path 20.

The image forming portion 14 includes a developing portion 26 that develops an electrostatic latent image formed in a photoconductor 32 described below and transfers a developed image onto the film 12, and a fixing portion 28 that is provided on a downstream side of the developing portion 26 and fixes an image, which is transferred to the film 12, on the film 12. The image forming portion 14 provided in the image forming apparatus 10 forms a toner image onto the film 12, as an example, using the liquid developer G (in a case in which the colors are distinguished, it is referred to as GY, GM, GC, and GK) of each color of Y, M, C, and K. Moreover, in the following description, symbol Y indicates a configuration for yellow, symbol M indicates a configuration for magenta, symbol C indicates a configuration for cyan, and symbol K indicates a configuration for black.

The developing portion 26 includes an image forming unit 30Y using a liquid developer GY including toner of the Y color, an image forming unit 30M using a liquid developer GM including toner of the M color, an image forming unit 30C using a liquid developer GC including toner of the C color, and an image forming unit 30K using a liquid developer GK including toner of the K color as an image forming unit 30. The image forming units 30Y, 30M, 30C, and 30K are disposed in the developing portion 26 along the transporting path 20 to face one surface of the film 12.

The toner image is formed in the image forming units 30Y, 30M, 30C, and 30K of each color in the developing portion 26 in accordance with the image data. In addition, the developing portion 26 transfers the toner image of each color formed by the image forming units 30Y, 30M, 30C, and 30K onto the film 12 in an overlapping manner thereby forming the toner image (toner image of color) on the film 12 in accordance with the image data. Moreover, details of the image forming unit 30 will be described later.

The fixing portion 28 includes a fixing roll 50 and a pressure roll 52. In the fixing portion 28, the film 12, onto which the toner image is transferred and which is fed, is interposed between the fixing roll 50 and the pressure roll 52, the film 12 is pressed while being heated, and the toner on the film 12 is melted and fixed to the film 12. Therefore, the film 12 to which the toner image is fixed is fed. The toner image is fixed to the film 12 and thereby the image in accordance with the image data is formed in the film 12. The film 12 is wound around and stored in the film discharge portion 18 in a roll shape.

Image Forming Unit

Figure 2:
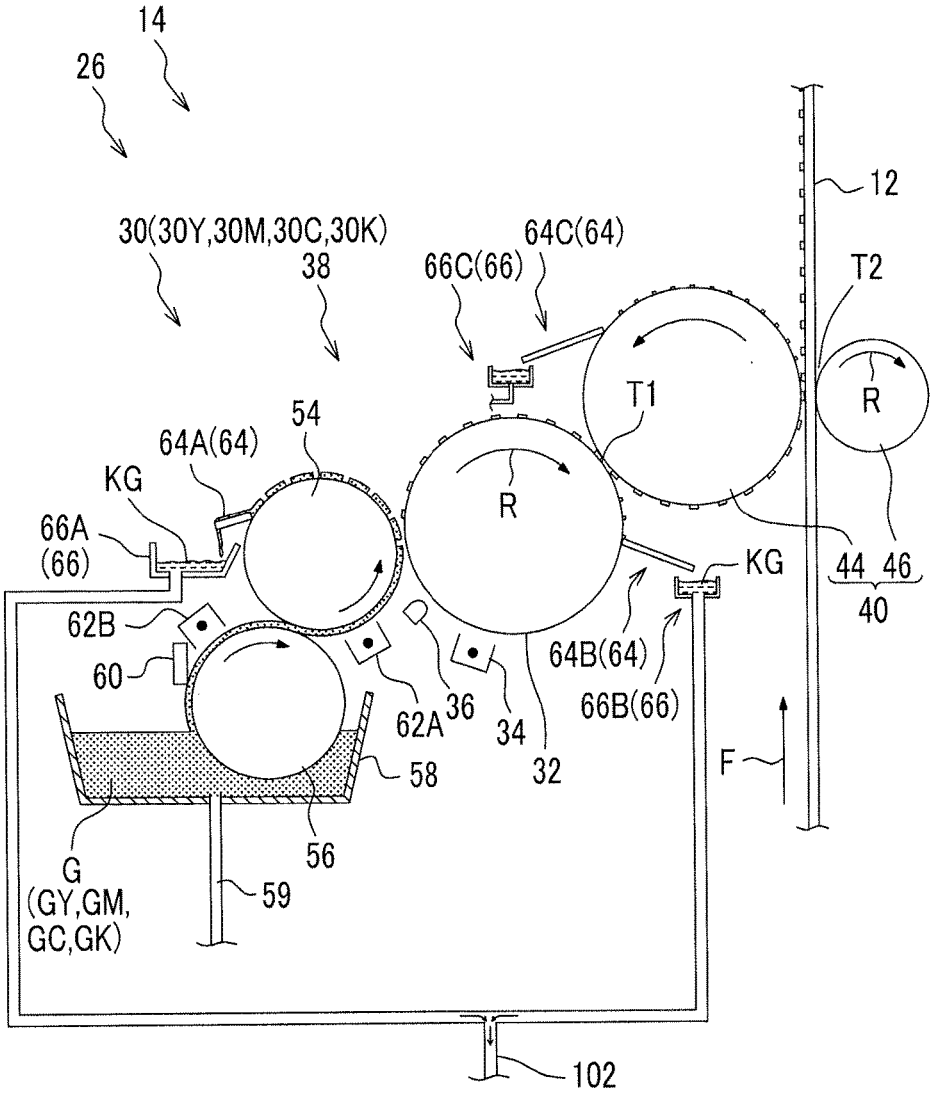
FIG. 2 is a configuration view illustrating an image forming unit configuring the image forming apparatus of FIG. 1.

An example of a configuration of a main portion of one image forming unit 30 is illustrated in FIG. 2. Moreover, the image forming units 30Y, 30M, 30C, and 30K are different in the liquid developer G to be used, but basic configurations thereof are the same as each other. In the following description, if the basic configuration is described, symbols Y, M, C, and K specifying the colors will be omitted.

Figure 3:
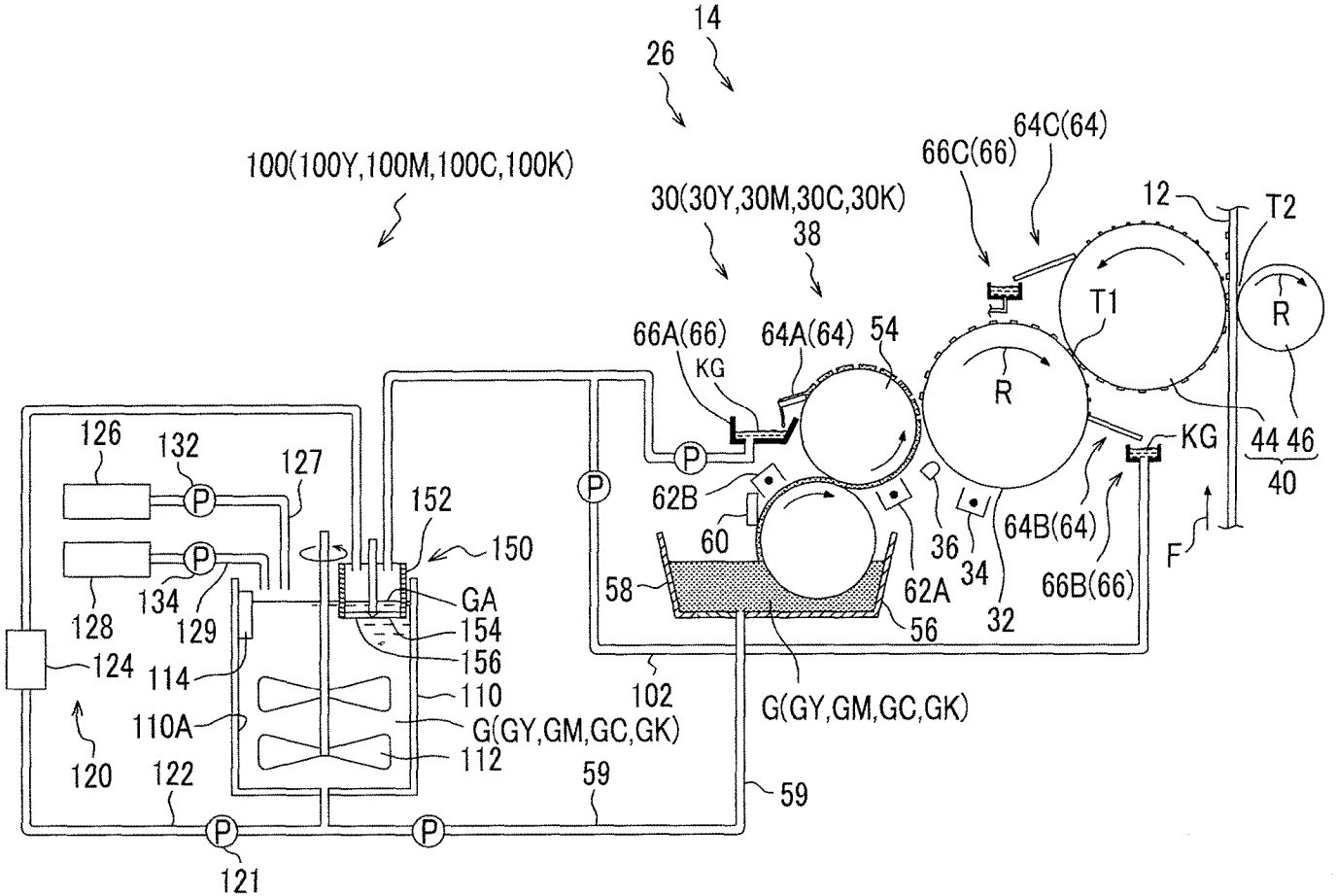
FIG. 3 is a configuration view illustrating the image forming unit and a developer device configuring the image forming apparatus of FIG. 1.

As illustrated in FIGS. 2 and 3, the image forming unit 30 (30Y, 30M, 30C, and 30K) includes the photoconductor 32 (32Y, 32M, 32C, and 32K), a charging unit 34 (34Y, 34M, 34C, and 34K), and an exposure device 36 (36Y, 36M, 36C, and 36K). In addition, the image forming unit 30 (30Y, 30M, 30C, and 30K) includes a developing device 38 (38Y, 38M, 38C, and 38K) and a transfer unit 40 (40Y, 40M, 40C, and 40K).

The photoconductor 32 is formed in a cylindrical shape as an example and holds the electrostatic latent image on an outer peripheral surface. In addition, the photoconductor 32 is rotated in a predetermined direction (arrow R direction in FIGS. 2 and 3) in accordance with a transporting speed of the film 12 transported along the transporting path 20. In the image forming unit 30, the charging unit 34, the exposure device 36, the developing device 38, and the transfer unit 40 are disposed on a periphery of the photoconductor 32 in a rotating direction of the photoconductor 32 in this order, and each member is disposed to face the outer peripheral surface of the photoconductor 32.

For example, corotron, scorotron, and the like are used for the charging unit 34 and a predetermined charge voltage is applied to the charging unit 34, and thereby the outer peripheral surface of the photoconductor 32 which faces the charging unit 34 is charged. The exposure device 36 applies light beams emitted in accordance with the image data to the outer peripheral surface of the photoconductor 32 that is charged while scanning the outer peripheral surface thereof. Therefore, the electrostatic latent image is formed on the outer peripheral surface of the photoconductor 32 in accordance with the image data.

The developing device 38 supplies the liquid developer G including the toner on the outer peripheral surface of the photoconductor 32 on which the electrostatic latent image is formed and develops the electrostatic latent image which is formed on the outer peripheral surface of the photoconductor 32. Therefore, the toner image is formed on the outer peripheral surface of the photoconductor 32 in accordance with the image data.

The transfer unit 40 includes an intermediate transfer roll 44 (44Y, 44M, 44C, and 44K) and a transfer roll 46 (46Y, 46M, 46C, and 46K). An outer peripheral surface of the intermediate transfer roll 44 is in contact with the outer peripheral surface of the photoconductor 32 in a position (primary transfer position T1) that is set in advance on a downstream side from the developing device 38 in the rotating direction of the photoconductor 32 and is driven to be rotated with respect to the photoconductor 32. In addition, the outer peripheral surface of the intermediate transfer roll 44 is disposed in a secondary transfer position T2 which is different from the primary transfer position T1 so as to be in contact with the film 12 transported along the transporting path 20. The transfer roll 46 is disposed to face the intermediate transfer roll 44 in the secondary transfer position T2 in which the transporting path 20 is interposed therebetween and is rotated to feed the film 12 (rotation in the arrow R direction).

In the image forming unit 30, a primary transfer voltage is applied from a power supply device (not illustrated) to the intermediate transfer roll 44 and thereby the toner image formed in the photoconductor 32 is primarily transferred onto the outer peripheral surface of the intermediate transfer roll 44 in the primary transfer position T1. In addition, in the image forming unit 30, a secondary transfer voltage is applied from the power supply device (not illustrated) to the transfer roll 46 and thereby the toner image which is transferred to the intermediate transfer roll 44 is transferred onto the film 12 in the secondary transfer position T2.

On the other hand, the developing device 38 of the exemplary embodiment includes, as an example, a developing roll 54 and a supply roll 56 of which outer shapes are respectively formed in a cylindrical shape. The developing device 38 includes a developer tank 58 storing the liquid developer G.

The liquid developer G is supplied from the developer device 100 which will be described later on the developer tank 58 by a developer supply path 59.

A part of an outer peripheral portion of the supply roll 56 is immersed in the liquid developer G within the developer tank 58. The developing roll 54 is disposed such that the outer peripheral surface thereof is in contact with the outer peripheral surface of the photoconductor 32 in which the electrostatic latent image is formed and is driven by the photoconductor 32 to be rotated. In addition, the outer peripheral surface of the supply roll 56 is in contact with the outer peripheral surface of the developing roll 54 and is driven by the developing roll 54 to be rotated. In addition, the supply roll 56 faces a blade 60 on a downstream side from a position in which the liquid developer G is immersed in the rotating direction. The blade 60 adjusts a thickness of a layer film of the liquid developer G adhering to the outer peripheral surface of the supply roll 56. Furthermore, the developing device 38 includes, as an example, a charging unit 62A that faces the outer peripheral surface of the developing roll 54 and a charging unit 62B that faces the outer peripheral surface of the supply roll 56. For example, corotron, scorotron, and the like are used for the charging units 62A and 62B.

In the developing device 38, the liquid developer G of the developer tank 58 adheres to the outer peripheral surface of the supply roll 56 by the rotation of the supply roll 56 to be pumped up and brought out. The thickness of the layer film of liquid developer G adhering to the supply roll 56 is adjusted by the blade 60.

The charging unit 62B is disposed, for example, on an upstream side from a contact position between the developing roll 54 and the supply roll 56 in the rotating direction of the supply roll 56, and charges the toner in the liquid developer G adhering to the outer peripheral surface of the supply roll 56. A supply voltage is applied from the power supply device (not illustrated) and thereby the liquid developer G adhering to the supply roll 56 adheres to the outer peripheral surface of the developing roll 54 and a thin film of the liquid developer G is formed.

The charging unit 62A is disposed on a downstream side from the contact position between the developing roll 54 and the supply roll 56 in the rotating direction of the developing roll 54, and an upstream side from a contact position between the photoconductor 32 and the developing roll 54 in the rotating direction of the developing roll 54. The charging unit 62B charges the toner of the liquid developer G adhering to the outer peripheral surface of the developing roll 54 in a predetermined polarity (for example, a positive polarity). In the developing device 38, a developing voltage is applied between the photoconductor 32 and the developing roll 54 from the power supply device (not illustrated) and thereby the toner of the liquid developer G adhering to the developing roll 54 adheres to the photoconductor 32 in accordance with the electrostatic latent image formed in the photoconductor 32. Therefore, the toner image in which the electrostatic latent image is developed by the toner is formed in the photoconductor 32.

On the other hand, the image forming unit 30 includes a recovery unit for recovering the liquid developer G that is not used for image formation on the film 12 among the liquid developer G that is brought out from the developer tank 58. The recovery unit includes a blade 64 of which one end in a width direction is in contact with the outer peripheral surface of each roll and a longitudinal direction is an axial direction of each roll, and a receiving container 66 which is opened and of which a longitudinal direction is the longitudinal direction of the blade 64.

In the developing roll 54, a blade 64A and a receiving container 66A face each other on a downstream side from the contact position between the developing roll 54 and the photoconductor 32 in the rotating direction and an upstream side from the contact position between the developing roll 54 and the supply roll 56. The blade 64A scrapes and removes the liquid developer G remaining on the outer peripheral surface of the developing roll 54, and the receiving container 66A recovers the liquid developer G which is scraped by the blade 64A. In the photoconductor 32, a blade 64B and a receiving container 66B face each other on a downstream side from a contact position between the photoconductor 32 and the intermediate transfer roll 44 in the rotating direction. The blade 64B scrapes and removes the liquid developer G (mainly toner) remaining on the outer peripheral surface of the photoconductor 32, and the receiving container 66B recovers the liquid developer which is scraped by the blade 64B. In the intermediate transfer roll 44, a blade 64C and a receiving container 66C face each other on a downstream side from a contact position (secondary transfer position T2) between the intermediate transfer roll 44 and the film 12 in the rotating direction, and on an upstream side of the contact position (primary transfer position T1) between the intermediate transfer roll 44 and the photoconductor 32. The blade 64C scrapes and removes the liquid developer G (mainly toner) remaining on the outer peripheral surface of the intermediate transfer roll 44, and the receiving container 66C recovers the liquid developer G which is scraped by the blade 64C.

Moreover, the liquid developer G recovered in the containers 66A and 66B is recovered in the developer device 100 described below by a recovery path 102. Moreover, for the sake of convenience, the liquid developer G recovered in the containers 66A and 66B is distinguished as a recovery developer KG.

Developer Device

As illustrated in FIG. 3, the developer devices 100Y, 100M, 100C, and 100K (also refer to FIG. 1) respectively supply the liquid developers GY, GM, GC, and GK on each of the developer tanks 58Y, 58M, 58C, and 58K of the image forming units 30Y, 30M, 30C, and 30K of the image forming apparatus 10. The developer device 100 is provided for each color (color of the toner) of the liquid developer G used in the image forming apparatus 10. Moreover, the developer device 100 of the liquid developer G of each color provided in the image forming apparatus 10 has a different color (color of the toner) of the liquid developer G to be supplied, but basic configurations thereof are the same as each other and one developer device 100 is described as an example without distinguishing the color (liquid developer G) in the following description.

The developer device 100 includes a storage portion 110 that stores the liquid developer G, a developer adjusting device 120, a dispersing device 150, and the like.

Storage Portion

Figure 5:
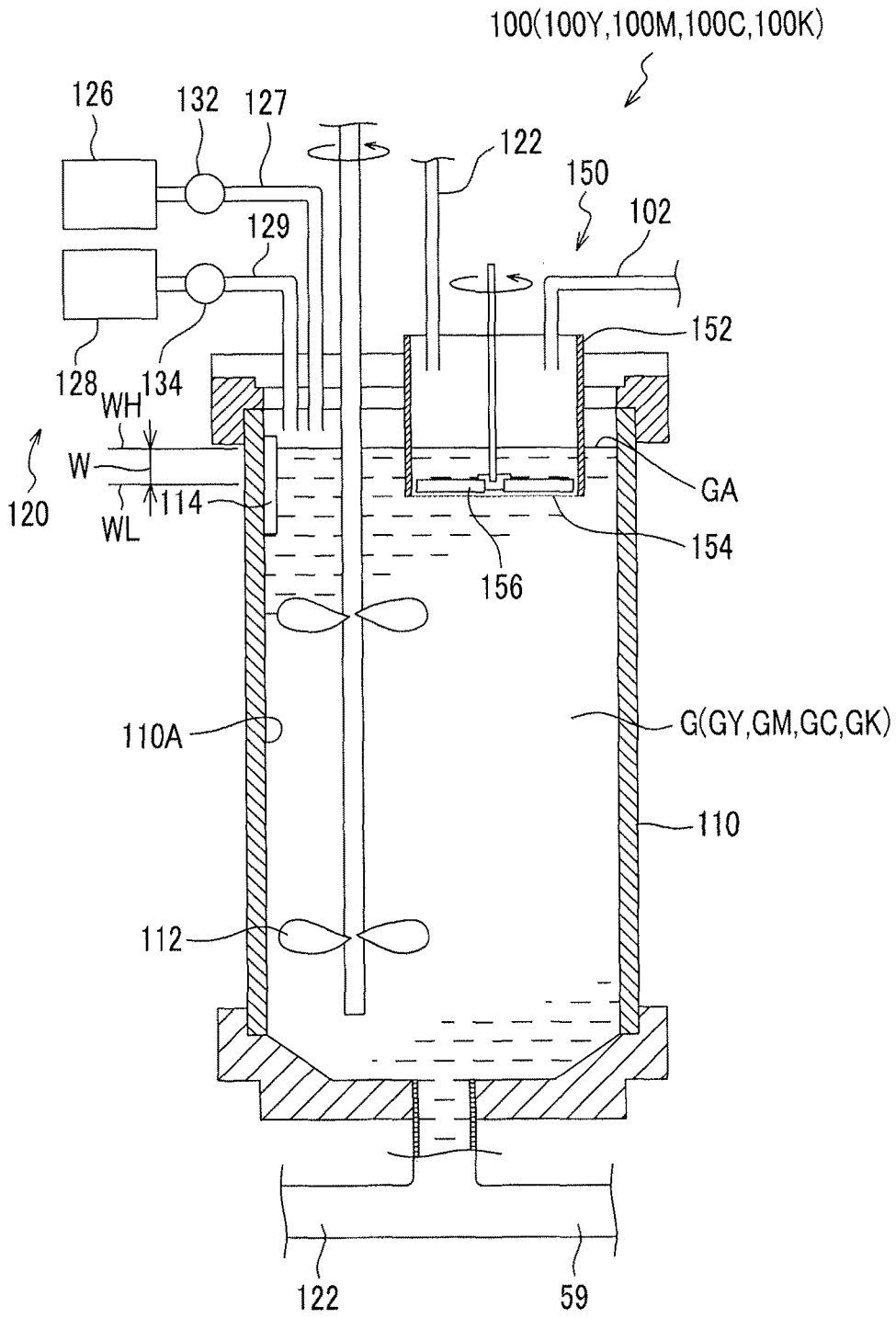
FIG. 5 is a configuration view illustrating the developer device configuring the image forming apparatus of FIG. 1.

As illustrated in FIGS. 3 and 5, the storage portion 110 is a container in which the liquid developer G containing the recovery developer KG is stored and includes an agitation member 112 that causes toner density to be constant by agitating the liquid developer G on the inside thereof. In addition, a liquid level detector 114 for detecting a liquid level GA of the liquid developer G is provided in an upper portion of a side wall 110A.

Dispersing Device

Figure 4:
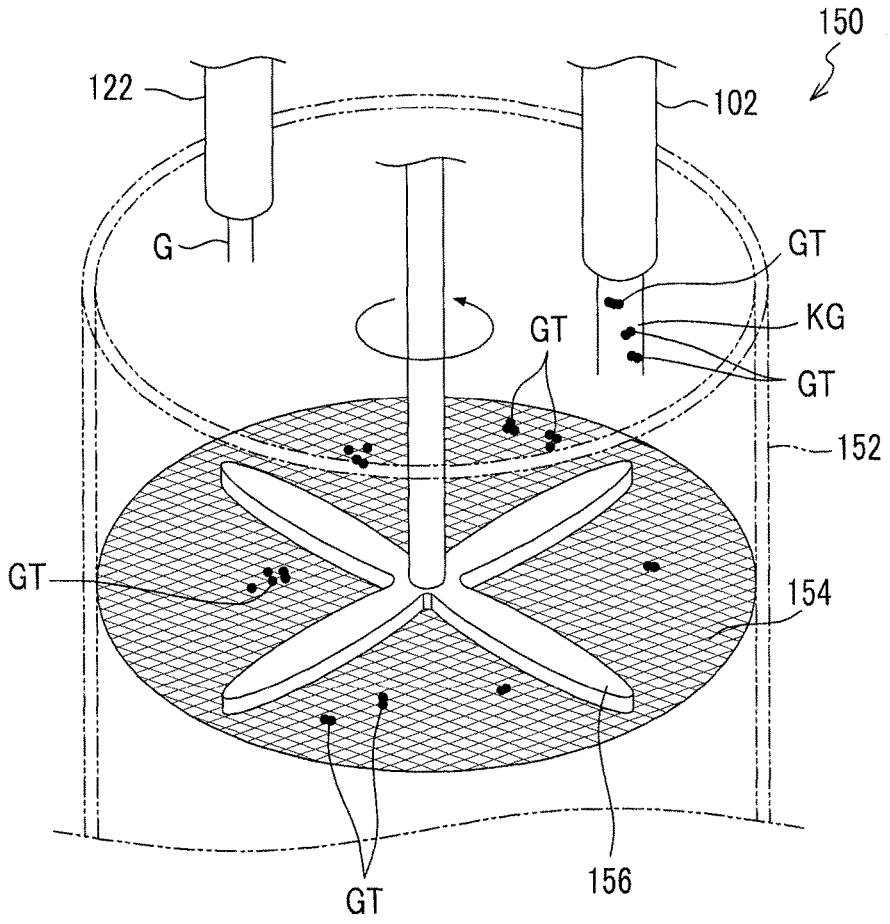
FIG. 4 is a perspective view illustrating a main portion of a dispersing device configuring the developer device.

As illustrated in FIGS. 3 to 5, the dispersing device 150 is a device that dissolves toner aggregated bodies GT (see FIG. 4) contained in the recovery developer KG that is recovered from each image forming unit 30 (see FIGS. 1 and 3) of the image forming portion 14 by applying shear force to the toner aggregated bodies GT, disperses the toner aggregated bodies GT in the recovery developer KG again, and delivers the toner aggregated bodies GT to the storage portion 110.

The dispersing device 150 includes a cylindrical portion 152, a net member 154 that is provided in a lower opening portion of the cylindrical portion 152, and a plate member 156 that is rotated.

Then, as illustrated in FIGS. 3 and 5, a lower portion of the cylindrical portion 152 is disposed in the liquid developer G and fixed so that the net member 154 is immersed in the liquid developer G of the storage portion 110.

Developer Adjusting Device

As illustrated in FIG. 3, the developer adjusting device 120 includes a detection path 122 in which a liquid developer pump 121 is provided and which absorbs the liquid developer G of the storage portion 110 and ejects the liquid developer G to the dispersing device 150, a detection portion 124 (for example, an ultrasonic type concentration sensor) that is provided in the detection path 122 and detects a concentration of the toner, a carrier liquid tank 126 that stores the carrier liquid, a high concentration developer tank 128 that stores high concentration developer of which a toner concentration is higher than a predetermined concentration range of a reference toner concentration, and the liquid level detector 114 (also see FIG. 5) that detects the liquid level GA of the liquid developer G described above.

The carrier liquid of the carrier liquid tank 126 is supplied on the storage portion 110 by a carrier liquid supply path 127 in which a carrier liquid pump 132 is provided. In addition, the high concentration developer of the high concentration developer tank 128 is supplied on the storage portion 110 by a high concentration developer supply path 129 in which a high concentration developer pump 134 is provided.

The controller 11 (see FIGS. 1 and 7) controls the liquid developer pump 121 (see FIG. 3) at a predetermined timing, absorbs the liquid developer G of the storage portion 110, ejects the liquid developer G to the dispersing device 150, and detects the toner concentration of the liquid developer G flowing through the detection path 122 using the detection portion 124.

The controller 11 (see FIGS. 1 and 7) controls the carrier liquid pump 132 and the high concentration developer pump 134 so that the toner concentration of the liquid developer G stored in the storage portion 110 is in the predetermined concentration range of the reference toner concentration based on the toner concentration detected by the detection portion 124. The controller 11 feeds the carrier liquid of the carrier liquid tank 126 and the high concentration developer of the high concentration developer tank 128 to the storage portion 110, and performs concentration adjustment.

Figure 7:
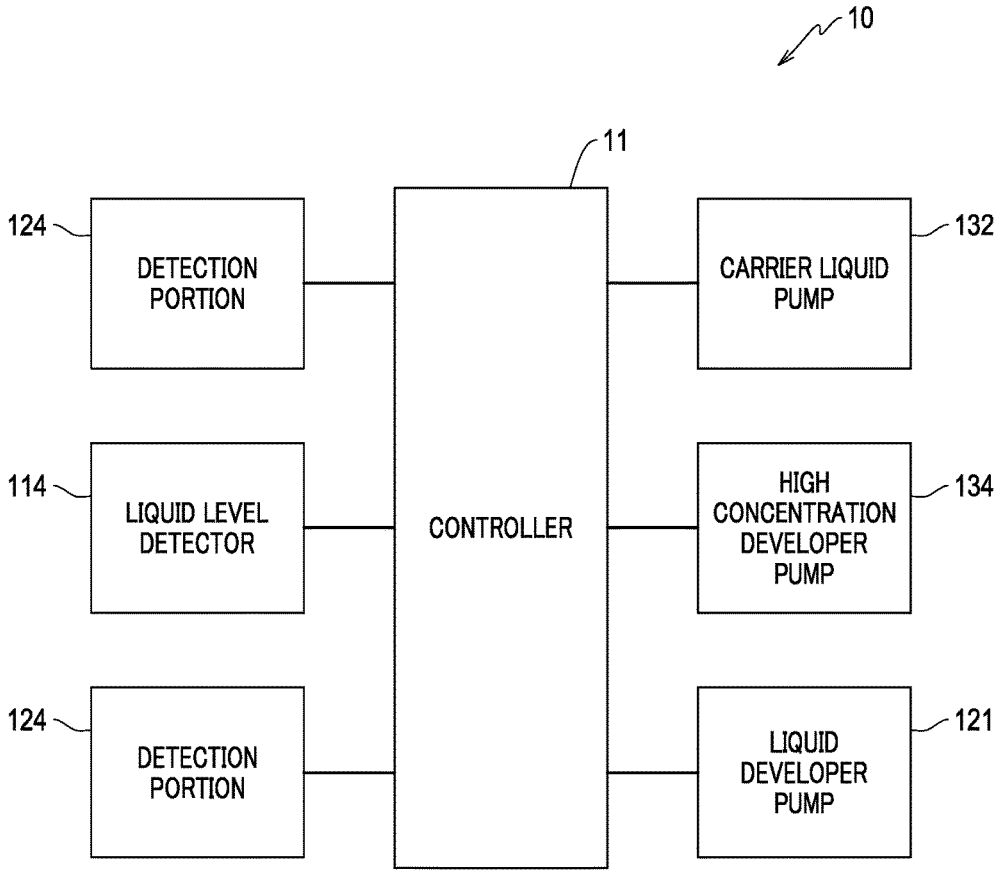
FIG. 7 is a block diagram of a main portion of the image forming apparatus of the first exemplary embodiment of the invention.

In addition, the controller 11 (see FIGS. 1 and 7) controls the carrier liquid pump 132 and the high concentration developer pump 134 based on a detection result of the liquid level GA of the liquid level detector 114 (see FIG. 7). The controller 11 feeds the carrier liquid of the carrier liquid tank 126 and the high concentration developer of the high concentration developer tank 128 to the storage portion 110, and adjusts the liquid level GA.

In this case, the liquid level GA is controlled to be within a predetermined liquid level range W. Moreover, an upper limit of the liquid level range W is an upper limit WH and a lower limit is a lower limit WL.

In addition, the lower limit WL is positioned above the net member 154 of the dispersing device 150. Described from a different point of view, the controller 11 controls the liquid level GA so that the net member 154 is immersed in the liquid developer G.

Operations and Effects

Next, operations and effects of the exemplary embodiment will be described.

As illustrated in FIG. 4, the recovery developer KG contains the toner aggregated bodies GT which are charged and aggregated due to electric charge imparted by the charging unit 62A during developing and friction during feeding the liquid. Then, the recovery developer KG transported to the net member 154 of the dispersing device 150 is rubbed against the net member 154 by the rotating plate member 156, the shear force (shear stress) is applied to the recovery developer KG, and the recovery developer KG passes through the net member 154. Thus, the toner aggregated bodies GT contained in the recovery developer KG are dissolved and dispersed again.

The liquid level GA of the liquid developer G of the storage portion 110 is configured so as to be positioned above the net member 154 of the dispersing device 150. That is, the liquid level GA is controlled so that the net member 154 of the dispersing device 150 is immersed in the liquid developer G stored in the storage portion 110. Therefore, drying of the net member 154 is prevented.

Figure 6:
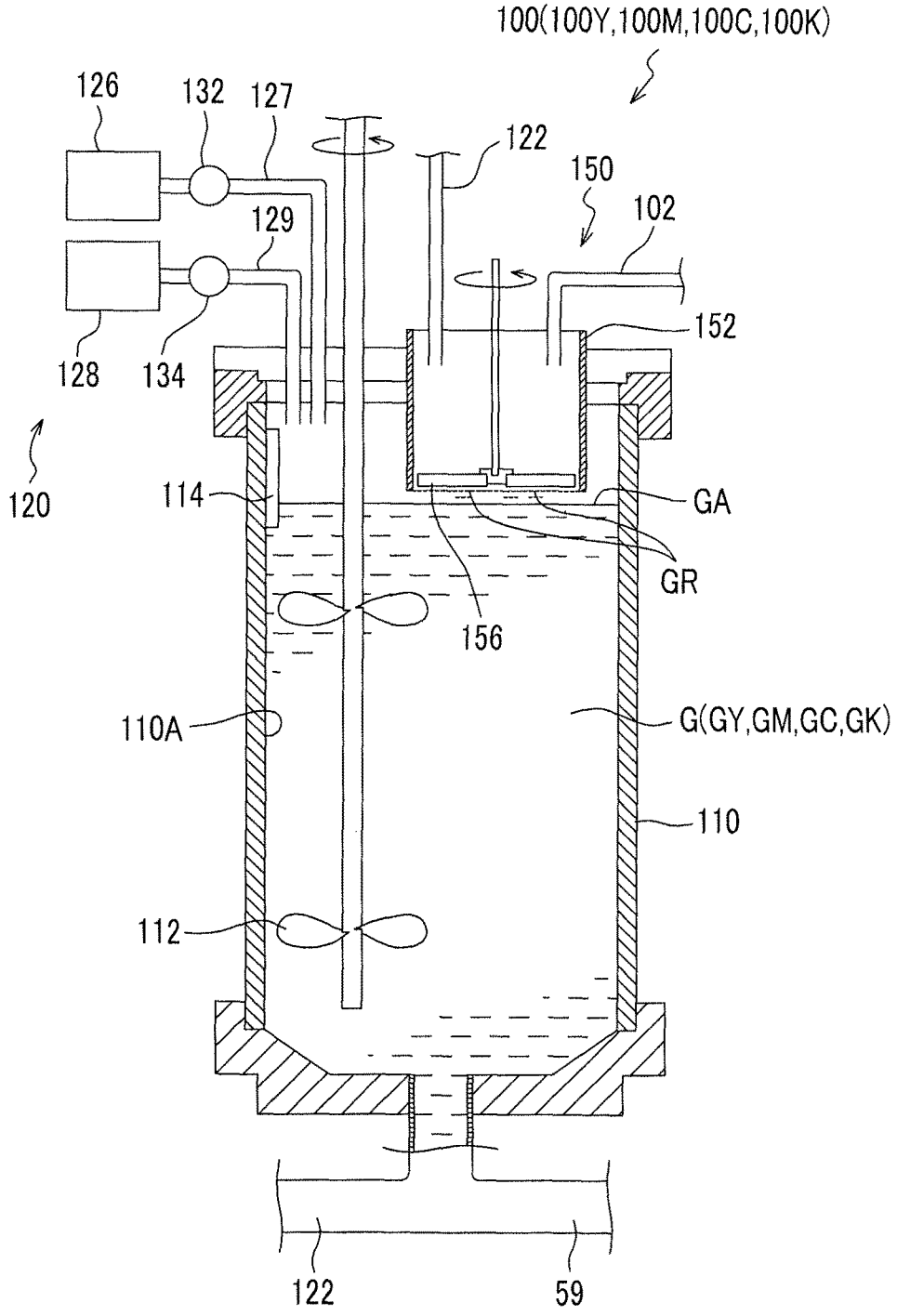
FIG. 6 a configuration view illustrating a developer device corresponding to FIG. 5 illustrating a state in which a net member is not immersed in liquid developer.

Here, as illustrated in FIG. 6, if the net member 154 is left for a long period of time (for example, several days) in a state where the net member 154 is not immersed in the liquid developer G, a volatile component of the recovery developer KG is evaporated and dried, and thereby the recovery developer KG fixed to the net member 154 and toner mass GR may occur. Then, if the toner mass GR falls in the storage portion 110, is mixed with the liquid developer G, and is fed to the image forming portion 14 together with the liquid developer G, image quality failure may occur.

In contrast, in the exemplary embodiment, as described above, the liquid level GA is controlled so that the net member 154 is immersed in the liquid developer G stored in the storage portion 110. Thus, drying of the net member 154 is prevented. In addition, the net member 154 is immersed in the liquid developer G and thereby the liquid developer G is uniformly replenished on the net member 154.

Therefore, the occurrence of the toner mass GR due to evaporation and drying of the volatile component of the liquid developer G is prevented. In addition, the occurrence of image quality failure due to falling of the toner mass GR onto the storage portion 110 and mixing thereof with the liquid developer G, and feeding of the toner mass GR to the image forming portion 14 together with the liquid developer G is prevented.

Others

In the exemplary embodiment, the net member 154 of the dispersing device 150 is controlled so that the liquid level GA is always positioned above the net member 154 of the dispersing device 150, but is not limited to the exemplary embodiment.

For example, in a case in which the lower limit WL of the liquid level range W of the liquid level GA is positioned below the net member 154 of the dispersing device 150 or, for example, the liquid level GA of the liquid developer G of the storage portion 110 is positioned below the net member 154 of the dispersing device 150 after the image forming operation is completed in the image forming portion 14 (while the image forming portion 14 does not form an image), the liquid level GA may be controlled so as to be positioned above the net member 154 of the dispersing device 150.

Otherwise, when a predetermined time is elapsed after the image forming operation is completed, in a case in which the liquid level GA of the liquid developer G of the storage portion 110 is positioned below the net member 154 of the dispersing device 150, the liquid level GA may be controlled so as to be positioned above the net member 154.

Second Exemplary Embodiment

An image forming apparatus of a second exemplary embodiment of the invention will be described. Moreover, since a developer device thereof is different from that of the first exemplary embodiment, the developer device will be described. In addition, the same reference numerals are given to the same members of the first exemplary embodiment and duplicate description will be omitted or simplified.

Liquid Developing Device

Figure 8:
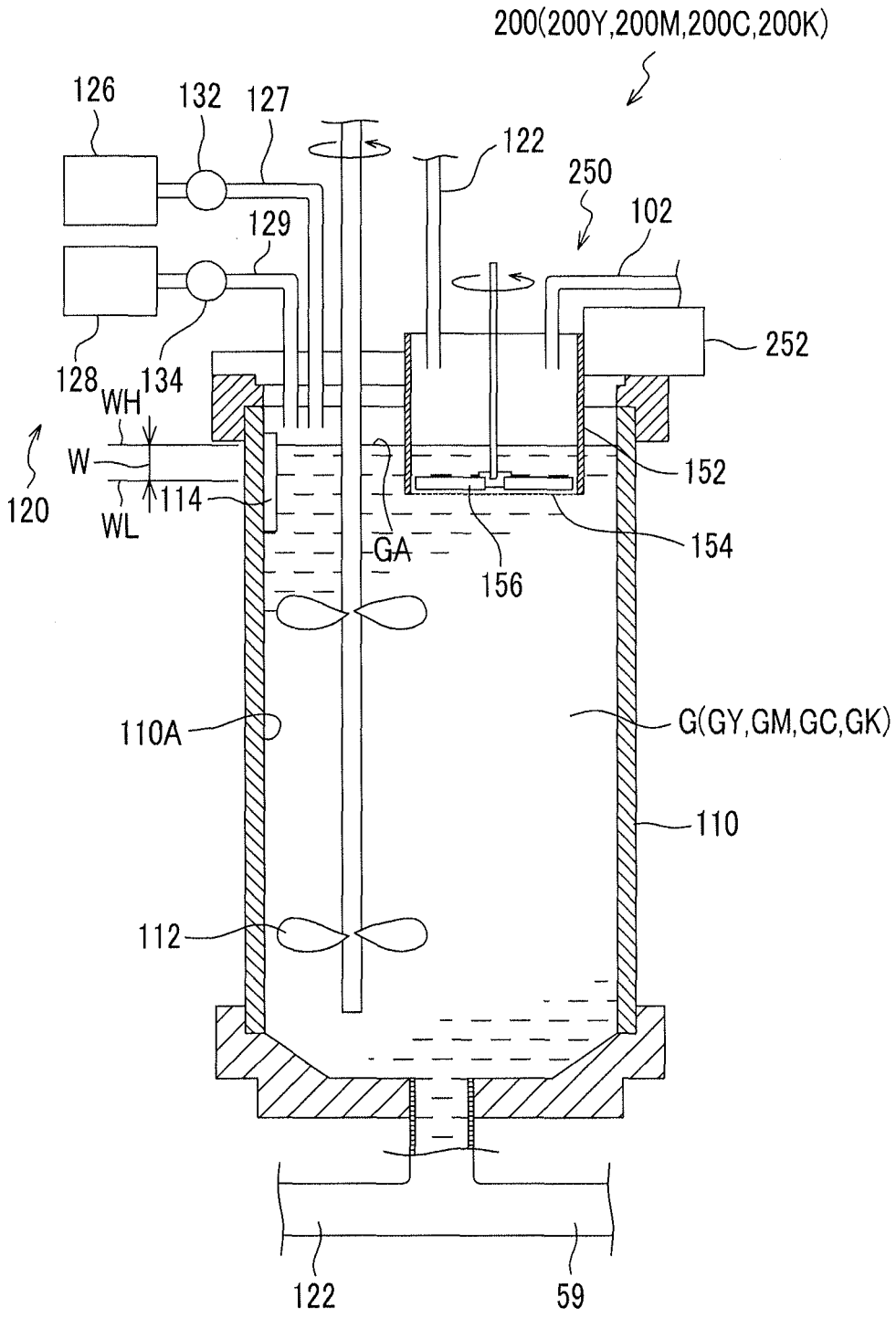
FIG. 8 is a configuration view illustrating a developer device of an image forming apparatus of a second exemplary embodiment of the invention.

A liquid developing device 200 illustrated in FIG. 8 includes the storage portion 110, the developer adjusting device 120, and a dispersing device 250.

Developer Adjusting Device

As illustrated in FIG. 8, the controller 11 (see FIGS. 1 and 9) controls the liquid developer pump 121 (also see FIG. 9) of the developer adjusting device 120 at a predetermined timing, absorbs the liquid developer G of the storage portion 110, ejects the liquid developer G to the dispersing device 150, and detects a toner concentration of the liquid developer G flowing through the detection path 122 using the detection portion 124.

The controller 11 (see FIGS. 1 and 9) controls the carrier liquid pump 132 and the high concentration developer pump 134 so that the toner concentration of the liquid developer G stored in the storage portion 110 is in a predetermined concentration range of a reference toner concentration based on the toner concentration detected by the detection portion 124. The controller 11 feeds a carrier liquid of the carrier liquid tank 126 and a high concentration developer of the high concentration developer tank 128 to the storage portion 110, and performs concentration adjustment.

Figure 9:
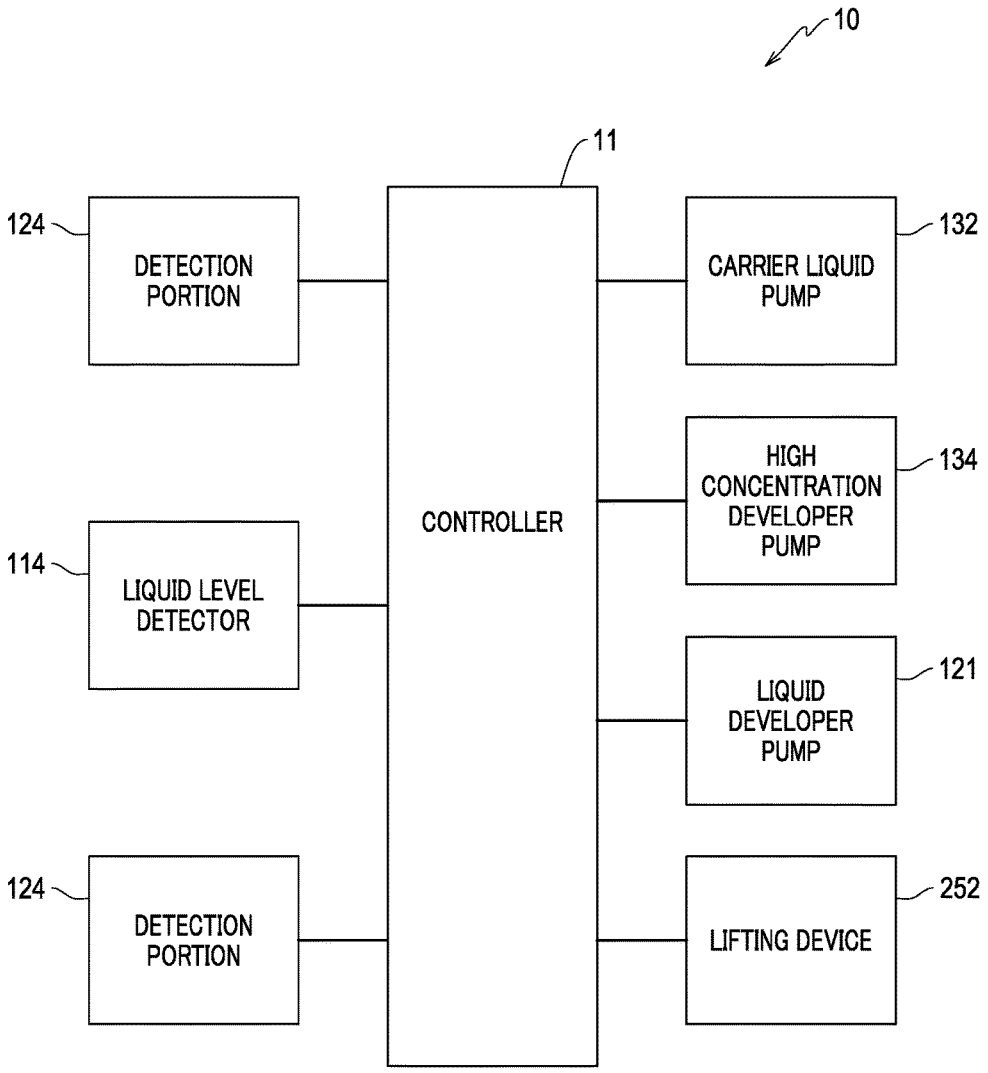
FIG. 9 is a block diagram illustrating a main portion of the image forming apparatus of the second exemplary embodiment of the invention.

In addition, the controller 11 (see FIGS. 1 and 9) controls the carrier liquid pump 132 and the high concentration developer pump 134 based on a detection result of the liquid level GA of the liquid level detector 114 (also see FIG. 9). The controller 11 feeds the carrier liquid of the carrier liquid tank 126 and the high concentration developer of the high concentration developer tank 128 to the storage portion 110, and adjusts the liquid level GA.

In this case, the liquid level GA is controlled to be within a predetermined liquid level range W. Moreover, an upper limit of the liquid level range W is an upper limit WH and a lower limit is a lower limit WL.

Dispersing Device

The dispersing device 250 is a device that dissolves toner aggregated bodies GT (see FIG. 5) contained in the recovery developer KG that is recovered from each image forming unit 30 (see FIGS. 1 and 3) of the image forming portion 14 by applying a shear force to the toner aggregated bodies GT, disperses the toner aggregated bodies GT again in the liquid developer G (of the carrier liquid), and delivers the toner aggregated bodies GT to the storage portion 110.

The dispersing device 250 includes a lifting device 252 that vertically moves the cylindrical portion 152.

The controller 11 (see FIGS. 1 and 9) controls the lifting device 252 based on a detection result of the liquid level detector 114 (also see FIG. 9) and controls the net member 154 of the dispersing device 250 so that the net member 154 of the dispersing device 250 is positioned below the liquid level GA of the liquid developer G of the storage portion 110.

Operations and Effects

Next, operations and effects of the exemplary embodiment will be described.

As illustrated in FIG. 4, the recovery developer KG contains the toner aggregated bodies GT which are charged and aggregated due to charge imparted by the charging unit 62A during developing and friction during feeding the liquid. Then, the recovery developer KG transported to the net member 154 of the dispersing device 250 is rubbed against the net member 154 by the rotating plate member 156, a shear force (shear stress) is applied to the recovery developer KG, and the recovery developer KG passes through the net member 154. Thus, the toner aggregated bodies GT contained in the recovery developer KG are dissolved and dispersed again.

The dispersing device 250 is controlled so that the net member 154 is positioned below the liquid level GA. That is, the net member 154 is controlled so as to be immersed in the liquid developer G stored in the storage portion 110. In addition, the net member 154 is immersed in the liquid developer G and thereby the liquid developer G is uniformly replenished on the net member 154. Therefore, drying of the net member 154 is prevented.

Therefore, occurrence of the toner mass GR due to evaporation and drying of the volatile component of the liquid developer G is prevented. In addition, occurrence of image quality failure due to falling of the toner mass GR onto the storage portion 110 and mixing thereof with the liquid developer G, and feeding of the toner mass GR to the image forming portion 14 together with the liquid developer G is prevented.

Others

In the exemplary embodiment, the net member 154 of the dispersing device 250 is controlled so as to be always positioned below the liquid level GA, but is not limited to the exemplary embodiment. The net member 154 of the dispersing device 150 may be controlled so as to be positioned below the liquid level GA only after the image forming operation is completed in the image forming portion 14 (while the image forming portion 14 does not form an image).

Otherwise, when a predetermined time is elapsed after the image forming operation is completed, in a case in which the liquid level GA of the liquid developer G of the storage portion 110 is positioned below the net member 154 of the dispersing device 250, the net member 154 of the dispersing device 250 may be controlled so as to be positioned below the liquid level GA.

Otherwise, after the image forming operation is completed (during image non-formation), the net member 154 of the dispersing device 250 may be controlled so as to be positioned above the liquid level GA after the net member 154 of the dispersing device 250 is lowered to be positioned below the liquid level GA whenever a predetermined time is elapsed. That is, the net member 154 may be controlled to be immersed in the liquid developer G for each fixed time. In addition, in this case, the net member 154 of the dispersing device 250 may be controlled to be positioned below the liquid level GA of the lower limit WL of the liquid level range W.

Third Exemplary Embodiment

An image forming apparatus of a third exemplary embodiment of the invention will be described. Moreover, since a developer device thereof is different from those of the first and second exemplary embodiments, the developer device will be described. In addition, the same reference numerals are given to the same members of the first and second exemplary embodiments and duplicate description will be omitted or simplified.

Developer Device

Figure 10:
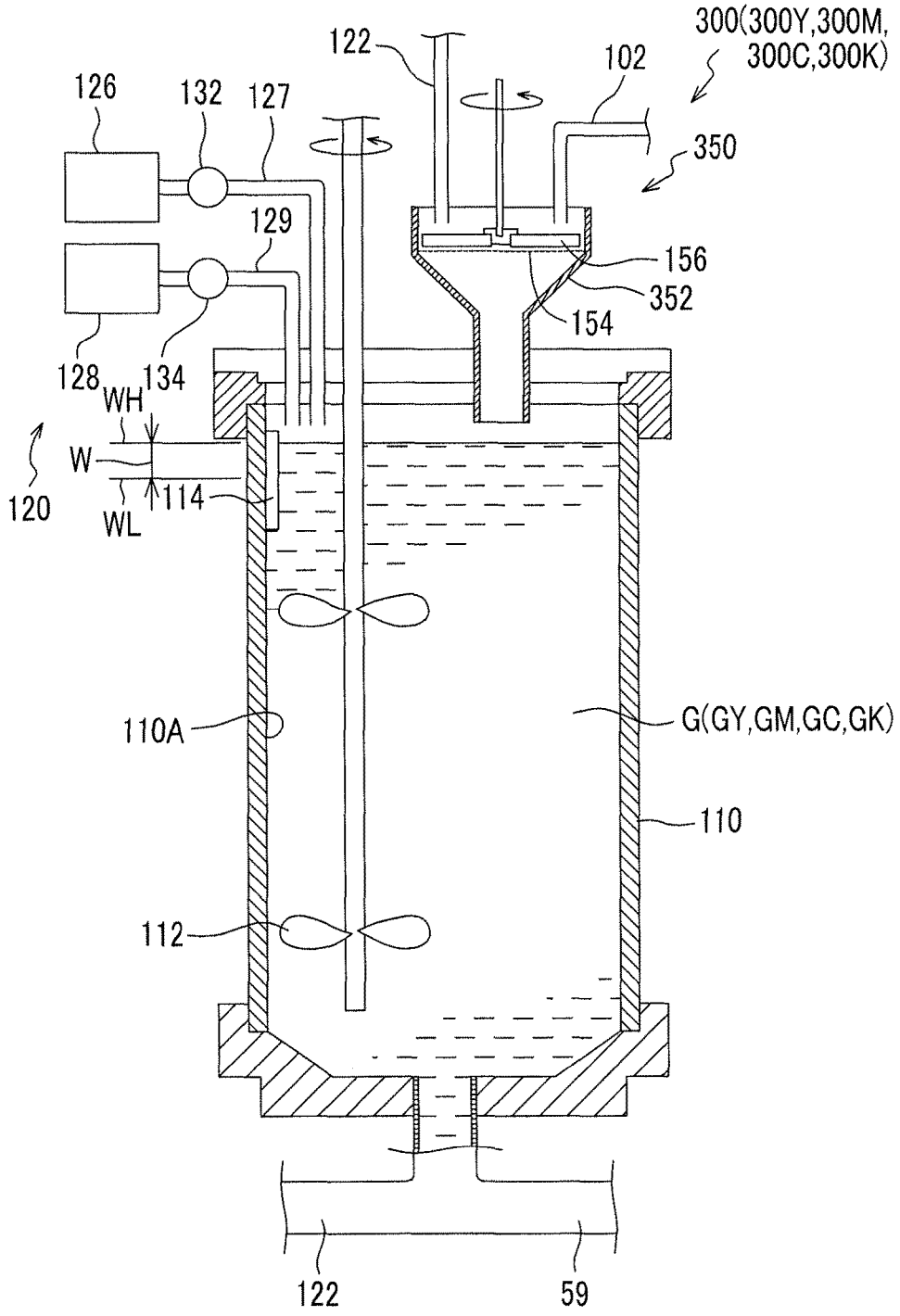
FIG. 10 is a configuration view illustrating a developer device of an image forming apparatus of a third exemplary embodiment of the invention.

As illustrated in FIG. 10, a developer device 300 includes the storage portion 110, a dispersing device 350, and the developer adjusting device 120.

Dispersing Device

As illustrated in FIG. 10, the dispersing device 350 includes a funnel portion 352, the net member 154 provided in an upper opening portion of the funnel portion 352, and the rotating plate member 156.

Developer Adjusting Device

The controller 11 (see FIGS. 1 and 7) controls the liquid developer pump 121 (see FIG. 7) configuring the developer adjusting device 120 at a predetermined timing, absorbs the liquid developer G of the storage portion 110, ejects the liquid developer G to the dispersing device 350, and detects a toner concentration of the liquid developer G flowing through the detection path 122 using the detection portion 124.

The controller 11 (see FIGS. 1 and 7) controls the carrier liquid pump 132 and the high concentration developer pump 134 so that the toner concentration of the liquid developer G stored in the storage portion 110 is in a predetermined concentration range of a reference toner concentration based on the toner concentration detected by the detection portion 124. The controller 11 feeds a carrier liquid of the carrier liquid tank 126 and a high concentration developer of the high concentration developer tank 128 to the storage portion 110, and performs concentration adjustment.

In addition, the controller 11 (see FIGS. 1 and 7) controls the carrier liquid pump 132 and the high concentration developer pump 134 based on a detection result of the liquid level GA of the liquid level detector 114 (also see FIG. 9). The controller 11 feeds the carrier liquid of the carrier liquid tank 126 and the high concentration developer of the high concentration developer tank 128 to the storage portion 110, and adjusts the liquid level GA.

In this case, the liquid level GA is controlled to be within a predetermined liquid level range W. Moreover, an upper limit of the liquid level range W is an upper limit WH and a lower limit is a lower limit WL.

Furthermore, the controller 11 controls the liquid developer pump 121, absorbs the liquid developer G of the storage portion 110, and ejects the liquid developer G to the net member 154 of the dispersing device 350 whenever a predetermined time is elapsed after the image forming operation is completed separately from the detection of the toner concentration. Thus, the liquid developer G is replenished on the net member 154.

Operations and Effects

Next, operations and effects of the exemplary embodiment will be described.

The recovery developer KG discharged to the dispersing device 350 is rubbed against the net member 154 by the rotating plate member 156 and passes through the net member 154. Thus, a shear force is applied to toner aggregated bodies GT (see FIG. 4) of the recovery developer KG. Thereby, the toner aggregated bodies GT (see FIG. 4) are dissolved and dispersed again.

The recovery developer KG in which the toner aggregated bodies GT are dissolved and dispersed again is collected by the funnel portion 352, falls, and stores in the storage portion 110.

The controller 11 controls the liquid developer pump 121, absorbs the liquid developer G of the storage portion 110, and ejects the liquid developer G to the net member 154 of the dispersing device 350, and replenishes the liquid developer G on the net member 154 whenever a predetermined time is elapsed separately from the detection of the toner concentration. Thus, drying of the net member 154 is suppressed.

Therefore, occurrence of the toner mass GR due to evaporation and drying of the volatile component of the liquid developer G is prevented. In addition, occurrence of image quality failure due to falling of the toner mass GR onto the liquid developer G of the storage portion 110 and mixing thereof with the liquid developer G, and feeding of the toner mass GR to the image forming portion 14 together with the liquid developer G is suppressed.

The detection path 122, in which the liquid developer pump 121 of the developer adjusting device 120 is provided and which absorbs the liquid developer G of the storage portion 110 and ejects the liquid developer G to the net member 154 of the dispersing device 350, has two functions of a concentration adjustment function of the liquid developer G and a replenishment function of the liquid developer G on the net member 154.

Fourth Exemplary Embodiment

An image forming apparatus of a fourth exemplary embodiment of the invention will be described. Moreover, since a developer device thereof is different from those of the first to third exemplary embodiments, the developer device will be described. In addition, the same reference numerals are given to the same members of the first to third exemplary embodiments and duplicate description will be omitted or simplified.

Developer Device

Figure 11:
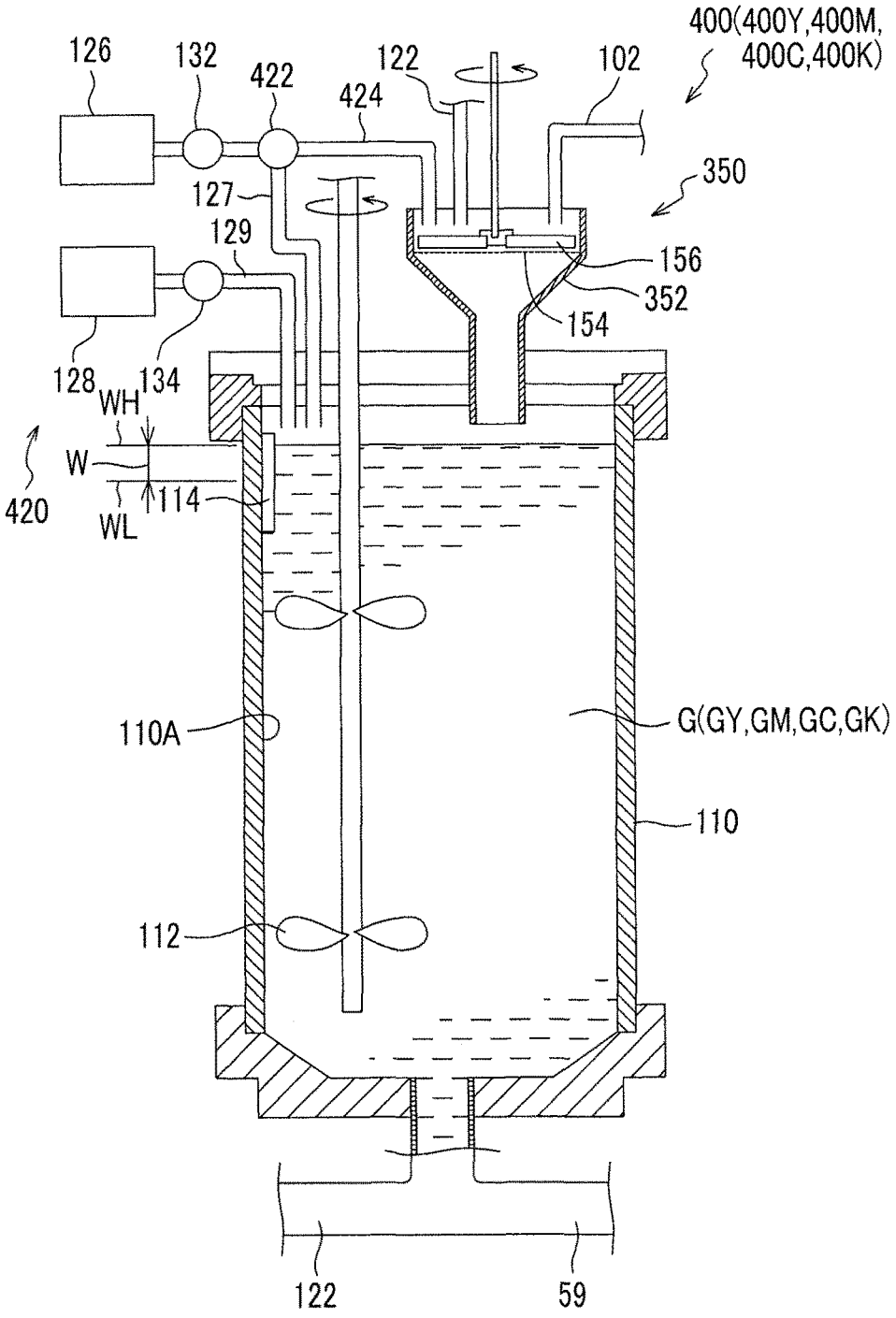
FIG. 11 is a configuration view illustrating a developer device of an image forming apparatus of a fourth exemplary embodiment of the invention.

As illustrated in FIG. 11, a developer device 400 includes the storage portion 110, the dispersing device 350, and a developer adjusting device 420.

Dispersing Device

As illustrated in FIG. 11, the dispersing device 350 includes the funnel portion 352, the net member 154 provided in an upper opening portion of the funnel portion 352, and the rotating plate member 156.

Developer Adjusting Device

In the developer adjusting device 420, a three-way valve 422 is provided in the carrier liquid supply path 127, a carrier liquid flows through a carrier liquid replenish path 424, the carrier liquid may be replenished on the net member 154 of the dispersing device 350.

Figure 12:
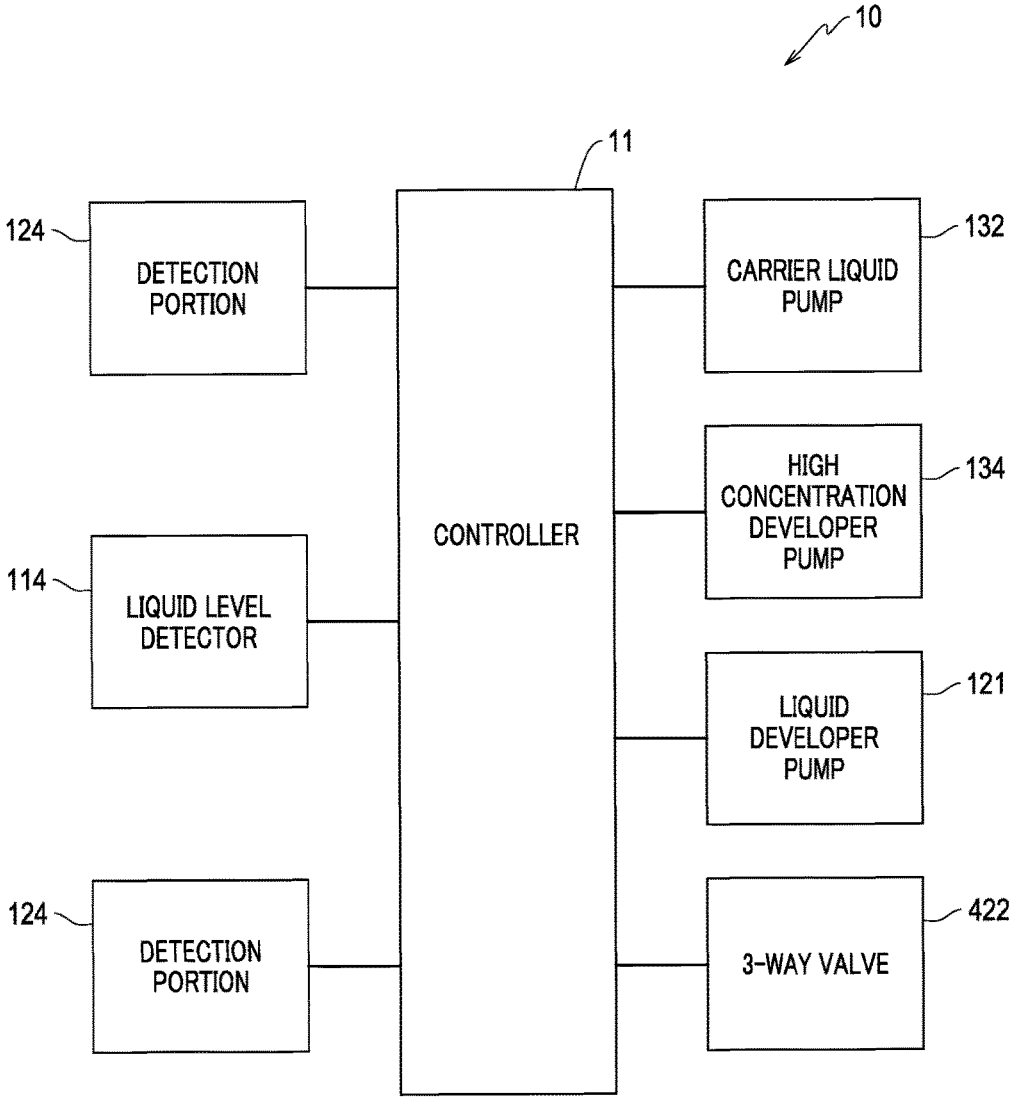
FIG. 12 is a block diagram illustrating a main portion of the image forming apparatus of the fourth exemplary embodiment of the invention.

The controller 11 (see FIGS. 1 and 12) controls the liquid developer pump 121 (see FIG. 12) at a predetermined timing, absorbs the liquid developer G of the storage portion 110, ejects the liquid developer G to the dispersing device 350, and detects a toner concentration of the liquid developer G flowing through the detection path 122 using the detection portion 124. The controller 11 (see FIGS. 1 and 12) controls the carrier liquid pump 132 and the high concentration developer pump 134 so that the toner concentration of the liquid developer G stored in the storage portion 110 is in a predetermined concentration range of a reference toner concentration based on the toner concentration detected by the detection portion 124. The controller 11 feeds a carrier liquid of the carrier liquid tank 126 and a high concentration developer of the high concentration developer tank 128 to the storage portion 110, and performs concentration adjustment.

In addition, the controller 11 (see FIGS. 1 and 12) controls the liquid developer pump 121, the carrier liquid pump 132, and the high concentration developer pump 134 based on a detection result of the liquid level GA of the liquid level detector 114 (also see FIG. 9). The controller 11 feeds the liquid developer G of the storage portion 110 to the dispersing device 150, or feeds the carrier liquid of the carrier liquid tank 126, and the high concentration developer of the high concentration developer tank 128 to the storage portion 110, and adjusts the liquid level GA.

In this case, the liquid level GA is controlled to be within a predetermined liquid level range W. Moreover, an upper limit of the liquid level range W is an upper limit WH and a lower limit is a lower limit WL.

In addition, the controller 11 (see FIGS. 1 and 12) controls the three-way valve 422 and the carrier liquid pump 132 at a predetermined timing and replenishes the carrier liquid on the net member 154 of the dispersing device 350. In addition, the controller 11 (see FIGS. 1 and 12) rotates the plate member 156 in accordance with the replenishment of the carrier liquid.

In the exemplary embodiment, a timing of the replenishment of the carrier liquid on the dispersing device 350 is after the completion of the image formation.

Operations and Effects

Next, operations and effects of the exemplary embodiment will be described.

The recovery developer KG discharged to the dispersing device 350 is rubbed against the net member 154 by the rotating plate member 156 and passes through the net member 154. Thus, a shear force is applied to toner aggregated bodies GT (see FIG. 4) of the recovery developer KG. Thereby, the toner aggregated bodies GT (see FIG. 4) are dissolved and dispersed again.

The recovery developer KG in which the toner aggregated bodies GT are dissolved and dispersed again is collected by the funnel portion 352, falls, and stores in the storage portion 110.

The controller 11 controls the three-way valve 422 and the carrier liquid pump 132, and replenishes the carrier liquid on the dispersing device 350 after the completion of the image formation. Therefore, drying of the net member 154 is suppressed and the recovery developer KG is washed away.

In addition, the controller 11 (see FIGS. 1 and 12) rotates the plate member 156 in accordance with the replenishment of the carrier liquid. Therefore, the recovery developer KG of the net member 154 is effectively washed out.

Thus, evaporation of the volatile component of the liquid developer G is suppressed. In addition, even if drying occurs, since the recovery developer KG is washed away from the net member 154, only the carrier liquid or most of the carrier liquid is present in the net member 154. Thus, occurrence of the toner mass GR is suppressed. Therefore, occurrence of image quality failure due to falling of the toner mass GR onto the liquid developer G of the storage portion 110, mixing thereof with the liquid developer G, and feeding of the toner mass GR to the image forming portion 14 together with the liquid developer G is suppressed.

Others

In the exemplary embodiment, the carrier liquid is replenished on the net member 154 of the dispersing device 350 once after the image formation, but is not limited to the exemplary embodiment. For example, after the image formation (during image non-formation), the drying may be further suppressed by replenishing the carrier liquid on the net member 154 of the dispersing device 350 periodically.

Others

In addition, the exemplary embodiments of the invention are not limited to the exemplary embodiments described above.

The above plural exemplary embodiments (also including the description of "Others") may be implemented by combining the exemplary embodiments appropriately.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a storage portion that stores liquid developer where toner is dispersed in a carrier liquid;

an image forming portion that forms an image on a recording medium with the liquid developer supplied from the storage portion;

a recovery path that recovers the liquid developer from the image forming portion and returns the liquid developer to the storage portion;

a dispersing mechanism that is provided in the recovery path and disperses recovered liquid developer by causing the recovered liquid developer to pass through a net member; and a replenishing unit that replenishes the liquid developer or the carrier liquid on the net member at least while the image forming portion does not form an image, wherein the recovery path is a pathway that extends between a unit housing the liquid developer recovered from the image formation portion and the dispersing mechanism, and wherein the recovery path, in a flow direction of the liquid developer, starts at the unit housing the liquid developer recovered from the image formation portion and ending at the dispersing mechanism.

2. The image forming apparatus according to claim 1, wherein the replenishing unit includes an immersing unit that replenishes the liquid developer on the net member by immersing the net member into the liquid developer stored in the storage portion.

3. The image forming apparatus according to claim 2, wherein the immersing unit includes a liquid level control mechanism that controls a liquid level of the liquid developer stored in the storage portion so as to be positioned above the net member.

4. The image forming apparatus according to claim 2, wherein the immersing unit includes a net member control mechanism that controls the net member so as to be positioned below the liquid level of the liquid developer stored in the storage portion by vertically moving the net member.

5. The image forming apparatus according to claim 3, wherein the immersing unit includes a net member control mechanism that controls the net member so as to be positioned below the liquid level of the liquid developer stored in the storage portion by vertically moving the net member.

6. The image forming apparatus according to claim 4, wherein the storage portion is controlled so that the liquid level falls within a predetermined range, and wherein the net member control mechanism controls the net member so as to be positioned below a lower limit value of the range.

7. The image forming apparatus according to claim 5, wherein the storage portion is controlled so that the liquid level falls within a predetermined range, and wherein the net member control mechanism controls the net member so as to be positioned below a lower limit value of the range.

8. The image forming apparatus according to claim 1, wherein the replenishing unit includes a liquid developer replenishing unit that replenishes the liquid developer by absorbing the liquid developer stored in the storage portion and ejecting the liquid developer to the net member.

9. The image forming apparatus according to claim 2, wherein the replenishing unit includes a liquid developer replenishing unit that replenishes the liquid developer by absorbing the liquid developer stored in the storage portion and ejecting the liquid developer to the net member.

10. The image forming apparatus according to claim 3, wherein the replenishing unit includes a liquid developer replenishing unit that replenishes the liquid developer by absorbing the liquid developer stored in the storage portion and ejecting the liquid developer to the net member.

11. The image forming apparatus according to claim 4, wherein the replenishing unit includes a liquid developer replenishing unit that replenishes the liquid developer by absorbing the liquid developer stored in the storage portion and ejecting the liquid developer to the net member.

12. The image forming apparatus according to claim 5, wherein the replenishing unit includes a liquid developer replenishing unit that replenishes the liquid developer by absorbing the liquid developer stored in the storage portion and ejecting the liquid developer to the net member.

13. The image forming apparatus according to claim 6, wherein the replenishing unit includes a liquid developer replenishing unit that replenishes the liquid developer by absorbing the liquid developer stored in the storage portion and ejecting the liquid developer to the net member.

14. The image forming apparatus according to claim 7, wherein the replenishing unit includes a liquid developer replenishing unit that replenishes the liquid developer by absorbing the liquid developer stored in the storage portion and ejecting the liquid developer to the net member.

15. The image forming apparatus according to claim 1, wherein the replenishing unit includes a carrier liquid replenishing unit that replenishes the carrier liquid on the net member.

16. The image forming apparatus according to claim 2, wherein the replenishing unit includes a carrier liquid replenishing unit that replenishes the carrier liquid on the net member.

17. The image forming apparatus according to claim 3, wherein the replenishing unit includes a carrier liquid replenishing unit that replenishes the carrier liquid on the net member.

18. The image forming apparatus according to claim 4, wherein the replenishing unit includes a carrier liquid replenishing unit that replenishes the carrier liquid on the net member.

19. The image forming apparatus according to claim 6, wherein the replenishing unit includes a carrier liquid replenishing unit that replenishes the carrier liquid on the net member.

20. The image forming apparatus according to claim 8, wherein the replenishing unit includes a carrier liquid replenishing unit that replenishes the carrier liquid on the net member.

21. The image forming apparatus according to claim 1, wherein the replenishing unit that replenishes the liquid developer or the carrier liquid is not connected with the dispersing mechanism such that the liquid developer or the carrier liquid is introduced directly into the storage portion.

* * * * *